US005705999A

United States Patent [19]

West et al.

[11] Patent Number: 5,705,999

[45] Date of Patent: Jan. 6, 1998

[54] ENGINE OPERATION DETECTION

[75] Inventors: Al West, Burnaby; Andrew Everett Loen, Port Alberni, both of Canada

[73] Assignee: Shell Oil Company, Houston, Tex.

[21] Appl. No.: 461,279

[22] Filed: Jun. 5, 1995

[51] Int. Cl.[6] ..... G08G 1/01

[52] U.S. Cl. ..... 340/941; 340/933; 364/436; 235/384

[58] Field of Search ..... 340/933, 938, 340/941; 364/436; 235/384

[56] References Cited

U.S. PATENT DOCUMENTS

| | | | |
|---|---|---|---|
| 4,038,633 | 7/1977 | King | 340/941 |
| 4,179,744 | 12/1979 | Lowe | 340/941 |
| 4,661,799 | 4/1987 | Buttemer | 340/941 |
| 4,862,162 | 8/1989 | Duley | 340/938 |
| 5,198,811 | 3/1993 | Potter et al. | 340/941 |
| 5,337,003 | 8/1994 | Carmichael | 324/402 |
| 5,361,064 | 11/1994 | Hamer et al. | 340/939 |
| 5,455,768 | 10/1995 | Johnson et al. | 340/941 |
| 5,512,891 | 4/1996 | Kang | 340/941 |

*Primary Examiner*—Jeffery Hofsass
*Assistant Examiner*—Daniel J. Wu

[57] ABSTRACT

A method and apparatus is provided for determining if a vehicle with an operating engine is at a particular location, the apparatus comprising: an antenna comprising a continuous wire formed into at least one loop; and a means to determine when the antenna is exposed to an oscillating electromagnetic field having a frequency between about 700 and about 2100 Hz of a strength characteristic of a vehicle's alternator operating in the vicinity of the antenna. In a preferred embodiment of the present invention, the sensor of the present invention further comprises a means to generate a signal when the antenna is exposed to the oscillating electromagnetic field having a frequency between about 700 and about 2100 Hz of a strength characteristic of a vehicle's alternator operating in the vicinity of the antenna, and the signal is used as an input into a logic system that requires that the signal not be generated in order for a refuelling system to refuel a vehicle in the vicinity of the antenna. The antenna is preferably a figure eight loop antenna placed in pavement below the location at which the vehicle is expected to be. The sensor of the present invention is particularly applicable as a input to disenable a fuel pump at a refuelling station.

6 Claims, 1 Drawing Sheet

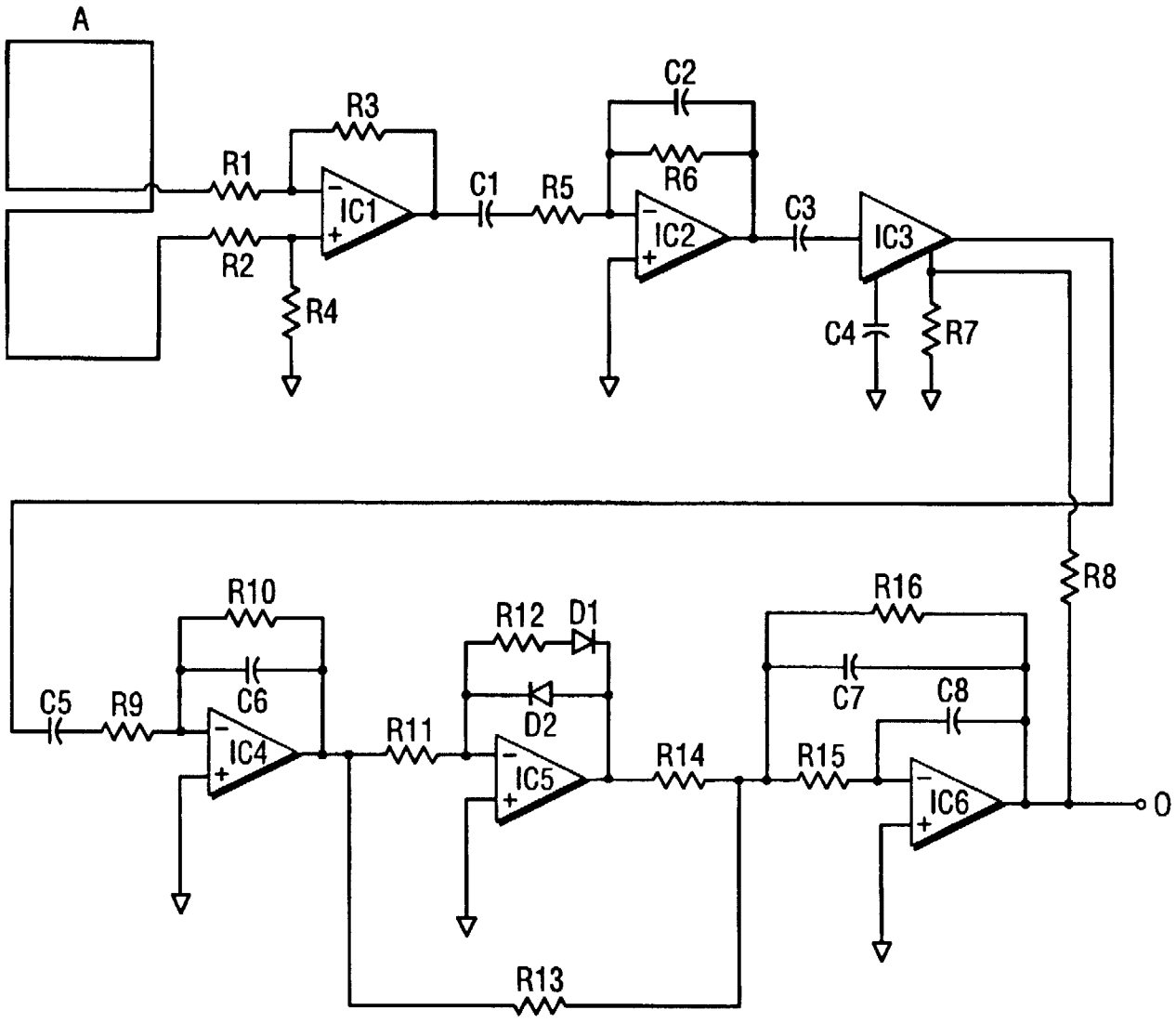
A
R1
R2
R3
IC1
R4
C1
R5
C2
R6
IC2
C3
IC3
C4
R7
R8
O
R9
C5
R10
C6
IC4
R11
R12
D1
D2
IC5
R13
R14
R15
R16
C7
C8
IC6

ENGINE OPERATION DETECTION

FIELD OF THE INVENTION

This invention relates to a method and apparatus for determining if a vehicle with an operating engine is at a particular location.

BACKGROUND TO THE INVENTION

Induction loops buried in pavement are typically used to determine if a vehicle is present at above the buried induction loop. These induction loops are most commonly used at traffic signals to trigger a change of the signal when a vehicle approaches or is present at the intersection.

U.S. Pat. No. 5,361,064 discloses both the typical induction loop design, and the patented improvement to such induction loops. The patented improvement is a compensation for periodic noise caused by such things as nearby power lines. The inductive sensor is driven by an oscillator to produce an oscillator signal having a frequency that is a function of the inductance of the sensor. Fluctuation of the frequency of the oscillator signal caused by the periodic noise is characterized during an initialization phase of operation. During normal measurement phase of operation, the measurement of the oscillator frequency is compensated for periodic noise based upon the prior noise characterization.

An inductive loop sensor will determine if a sizable mass of metal is located near the induction loop, but cannot differentiate between a vehicle with the engine operating and a vehicle with the engine not operating. Refuelling stations require that the engine of a vehicle not be running when the vehicle is being refuelled, but if the station is a self-service station, it is up to the customer to turn off the ignition of the vehicle. It would be desirable to have a sensor that could automatically determine if the engine of the vehicle is operating. A determination that the vehicle's engine is not operating could be used as a prerequisite for operation of the fuel pump. Many gasoline pumps have visual displays for communication instructions to the customer, and such a visual display could include a notice that the ignition of the vehicle needs to be turned off before the pump can be started. This notice could be triggered by an indication that an operating vehicle engine is present, if such an indication were available.

A determination that the engine of a vehicle is not operating may be even more important for a refuelling station that is equipped to automatically refuel a vehicle. In an automatic refuelling system, the driver will stay seated in the vehicle as the system proceeds to refuel the vehicle. If the driver does not have to leave the vehicle, it may be more likely that the driver will forget to shut off the ignition, or more likely that the driver will choose to not shut off the ignition in order to remain more comfortable because of continued operation of an air conditioner.

It could also be desirable to have an indication if the vehicle's engine is operating in an automated refuelling system to discontinue refuelling and remove the fuel dispenser if the driver starts the vehicle's engine with an intention of driving away.

U.S. Pat. No. 5,337,003 suggests a system to measure the lapsed time an engine is operating by a timer that operates when a sensor placed around an ignition wire detects repeated spark impulses. The engine operation is therefore sensed by the impulse to the ignition, but a sensor clamped around the ignition wire is needed for this determination. An engine operation sensor at a fixed location would have to sense the operation of an engine without contact with the engine itself. Further, such a system will not be applicable to a diesel engine.

It is therefore an object of the present invention to provide a method and an engine operation sensor capable of sensing if an engine is operating at a predetermined location. It is a further object to provide such a method and sensor that is capable of determining if such an engine is operating whether the engine is a diesel or has an ignition system.

SUMMARY OF THE INVENTION

These and other objects are accomplished by an engine operation sensor comprising: an antenna comprising a continuous wire formed into at least one loop; and a means to determine when the antenna is exposed to an oscillating electromagnetic field having a frequency between about 700 and about 2100 Hz of a strength characteristic of a vehicle's alternator operating in the vicinity of the antenna. In a preferred embodiment of the present invention, the sensor of the present invention further comprises a means to generate a signal when the antenna is exposed to the oscillating electromagnetic field having a frequency between about 700 and about 2100 Hz of a strength characteristic of a vehicle's alternator operating in the vicinity of the antenna, and the signal is used as an input into a logic system that requires that the signal not be generated in order for a refuelling system to refuel a vehicle in the vicinity of the antenna.

The means to determine when the antenna is exposed to an oscillating electromagnetic field having a frequency between about 700 and about 2100 Hz of a strength characteristic of a vehicle's alternator operating in the vicinity of the antenna is preferably a combination of at least one high-pass filter, and at least one low-pass filter, the two filters capable of filtering antenna output of frequencies greater than about 2100 Hz and frequencies less than about 700 Hz. The antenna is preferably a figure eight loop antenna placed in pavement below the location at which the vehicle is expected to be.

The sensor of the present invention is particularly applicable as a input to disenable a fuel pump at a refuelling station when engine operation is detected.

BRIEF DESCRIPTION OF THE DRAWINGS

FIG. 1 is a schematic drawing of an electrical circuit and antenna according to the present invention.

DETAILED DESCRIPTION OF THE PRESENT INVENTION

The present invention utilizes the alternating magnetic field of a vehicle's alternator to determine if a vehicle's engine is operating in the vicinity of the antenna. The antenna is preferably in a loop configuration, and more preferably, in a figure-8 configuration. These configurations reduce the noise that the antenna will pick up from other sources. The antenna is preferably a plurality of such loops in order to generate a stronger signal. About four figure-8 loops, with a each half of the figure-8 loop being a four foot square has been found to be an acceptable antenna. This antenna may be buried in pavement or concrete below a point at which a vehicle is expected to be. Alteratively, the antenna may be attached to a support and placed above that location or placed directly on the pavement. The antenna is preferably placed under the position at which the vehicle is expected to be, but may alternatively be placed in an overhead canopy. Placing the antenna below the position at which the vehicle is expected to be is preferred because this results in the antenna be closest to the alternator, and therefore exposed to a stronger electromagnetic field.

The electromagnetic field created by an operating alternator will be cyclic, with a frequency that varies according to the speed at which the alternator is rotating. The frequency of the cycling is the primary distinction between the electromagnetic field created by an alternator compared to electromagnetic fields created by electric motors, electric motors generally creating electromagnetic fields that cycle at higher frequencies. Electrical motors may be operating to rotate a radiator or air conditioner fan for a time period after the vehicle's engine is turned off. Also, electrical motors may be used, for example, to open or close windows, or to extend or retract the vehicle's radio antenna. It is therefore significant that frequencies such as those created by such electrical motors be eliminated from the signal from the antenna of the present invention. Additionally, it is important that lower frequencies such as those generated by transmission of 60 Hz power be filtered.

Referring now to FIG. 1, a circuit is schematically shown that is capable of filtering high and low frequency noise from the antenna signal, and rectifying and amplifying the remaining signal. The antenna A is shown as a FIG. 8 shaped antenna with two leads extending from the antenna. The two leads are preferably transmitted through a coaxial cable to minimize noise picked up by the conduits between the antenna and the remaining portion of the circuit. The two leads pass through resistors R1 and R2, which can be 10 kΩ resistors, and to input amplifier IC1. Amplifier IC1 can be a LM324 amplifier available from National Semiconductor, of Santa Clara, Calif.

One of the two leads from the antenna is grounded at the input of the input amplifier through a resistor R4, which can be another 10 kΩ resistor. Feedback from the output to the input of the input amplifier is provided through resistor R3, which can be a 10 kΩ resistor. The signal from the input amplifier is passed through a capacitor and resistor pair C1 and R5 which function as a high-pass filter. C1 can be a 0.22 μF capacitor and R5 can be a 1 kΩ resistor.

The amplified signal from the first high pass filter is passed through a low pass filter, the low pass filter consisting of an amplifier IC2, a resistor R6 and a capacitor C2 is parallel. The capacitor can be a 75 nF capacitor and the resistor can be a 1 MΩ resistor.

The signal then passes through capacitor C3 which can be a one μF capacitor. C3 serves to decouple the following gain control circuitry.

The signal is then passed through an amplifier, IC3 to provide gain control using feedback from the output signal O, through resistor RS, with the feedback signal grounded through resistor R7. IC3 can be a MC3340 amplifier available from Motorola of Phoenix, Ariz. R7 and R8 can both be 3.3 kΩ resistors.

The amplified signal is then passed through another capacitor and resistor pair C5 and R9 that serve as another high pass filter, and another low pass filter consisting of IC4, E10 and C6. C5 can be a 0.22 μF capacitor, R9 can be a 1 kΩ resistor, IC4 can be a TL072 amplifier, R10 can be a 1MΩ resistor and C6 can be a 75 nF capacitor.

This second set of high pass and low pass filters effectively eliminate noise having frequencies less than about 700 Hz and greater than about 2100 Hz.

The signal from the second set of high pass and low pass filters is then rectified to generate a signal having a voltage proportional to the integral of the absolute value of the amplified signals passing through the high pass and low pass filters. Amplifiers IC5 and IC6, diodes D1 and D2, resistors R11, R12, R13, R14, R15, and R16, and capacitors C7 and C8 provide this rectification. The resistors can be, respectively, 20 kΩ, 20 kΩ, 200 kΩ, 100 kΩ, 1 kΩ, and 200 kΩ resistors. The amplifiers can be TL072 amplifiers. The diodes can both be 1N914 diodes available from International Rectifier, of El Segundo, Calif. The capacitors can be 1 μF and 33 pF capacitors, respectively.

The elements of this circuit can be sequenced in many different ways, and different numbers of high and low pass filters can be provided depending on the extent to which noise outside of the desired frequency range is to be eliminated. Further, the parameters suggested for the components shown in FIG. 1 are exemplary, and persons of ordinary skill in the art are capable of designing circuits that are functionally similar.

The antenna of the present invention may have additional functions, such as also being an antenna for a system to determine if a vehicle is located above or in the vicinity of the antenna by a method such as one of those disclosed in U.S. Pat. No. 5,361,064. The antenna could therefore be a component of a system effective to determine if a vehicle is present, and if the engine of the vehicle is operating. Such a system could sequence refuelling instructions to the operator of the vehicle at a refuelling station and disenable the fuel pump if the vehicle's engine is operating. A preferred mode of practicing the present invention is therefore to place the antenna adjacent to a fuel dispenser, and using an output generated by the system of the present invention to disenable the fuel pump.

The preceding description of the invention is exemplary, and reference to the following claims is made to determine the full scope of the present invention.

We claim:

1. A method to determine if an vehicle's engine is operating at a particular location, the method comprising the steps of:

providing an antenna comprising an insulated continuous wire formed into at least one loop at the particular location;

determining when a vehicle's engine is operating at that particular location by determining when the antenna is exposed to an oscillating electromagnetic field having a frequency between about 700 and about 2100 Hz of a strength characteristic of a vehicle's alternator operating in the vicinity of the antenna; and generating a signal when the antenna is exposed to the oscillating electromagnetic field having a frequency between about 700 and about 2100 Hz of a strength characteristic of a vehicle's alternator operating in the vicinity of the antenna comprises passing the signal from the antenna through least one high pass filter and at least one low pass filter wherein the signal is an input into a logic system that requires that the signal not be generated in order for a refuelling system to refuel a vehicle in the vicinity of the antenna.

2. The method claim 1 wherein determining if the antenna is exposed to an oscillating electromagnetic field having a frequency between about 700 and about 2100 Hz of a strength characteristic of a vehicle's alternator operating in the vicinity of the antenna comprises passing the signal from the antenna through a plurality of high-pass filters, and a plurality of low-pass filters, the high pass filters effective to essentially eliminate electrical noise having a frequency less than about 700 Hz and the low pass filters effective to essentially eliminate electrical noise having a frequency greater than about 2100 Hz.

3. The method of claim 1 wherein the antenna is a figure eight loop antenna placed in pavement below the location at which the vehicle is expected to be.

4. The method of claim 1 wherein the antenna is placed in pavement adjacent to a fuel dispenser.

5. The method of claim 2 wherein the determination of when the antenna is exposed to an oscillating electromagnetic field having a frequency between about 700 Hz and about 2100 Hz further comprises rectifying the signal from the antenna to convert the alternating signal from the antenna to a direct current voltage differential, a direct current voltage differential above a threshold level indicative of an operating vehicle engine.

6. The method of claim 5 wherein the determination of when the antenna is exposed to an oscillating electromagnetic field having a frequency between about 700 Hz and about 2100 Hz further comprises an amplifying the differential potential between leads of the antenna.

* * * * *